US006318457B1

(12) United States Patent
Den Boer et al.

(10) Patent No.: US 6,318,457 B1
(45) Date of Patent: Nov. 20, 2001

(54) MULTILATERAL WELL AND ELECTRICAL TRANSMISSION SYSTEM

(75) Inventors: Johannis Josephus Den Boer; Simon Lawrence Fisher; Anthony Evert Kuperij; John Foreman Stewart, all of Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/494,803

(22) Filed: Jan. 31, 2000

(30) Foreign Application Priority Data

Feb. 1, 1999 (EP) ..... 99300718

(51) Int. Cl.[7] ..... E21B 23/00; E21B 34/06; E21B 34/16

(52) U.S. Cl. ..... 166/66.7; 166/50; 166/207; 166/334.4

(58) Field of Search ..... 166/50, 65.1, 66.7, 166/207, 313, 334.4

(56) References Cited

U.S. PATENT DOCUMENTS

| | | | |
|---|---|---|---|
| 4,484,627 | 11/1984 | Perkins | 166/248 |
| 4,839,644 | 6/1989 | Safinya et al. | 340/854 |
| 5,348,095 | 9/1994 | Worrall et al. | 166/380 |
| 5,706,892 | 1/1998 | Aeschbacher, Jr. et al. | 166/66 |
| 5,721,538 | 2/1998 | Tubel et al. | 340/853.4 |

FOREIGN PATENT DOCUMENTS

| | | |
|---|---|---|
| 295178 | 12/1988 | (EP) . |
| 823534 | 11/1998 | (EP) . |
| 2322740 | 9/1998 | (GB) . |
| 80/00727 | 4/1980 | (WO) . |
| 93/26115 | 12/1993 | (WO) . |
| 96/21085 | 7/1996 | (WO) . |

OTHER PUBLICATIONS

Foreign Search Report dated Jun. 30, 2000.

Brockman, M. et al "Drilling and Completing Multiple Lateral Sections from One Borehole" Offshore, vol. 55, No. 5, May 1995, pp. 130–134.

*Primary Examiner*—David Bagnell
*Assistant Examiner*—Jennifer M Hawkins

(57) ABSTRACT

There is provided a multilateral well and electric transmission system comprising a branch well tubular in a branch wellbore which is connected in an electrically conductive manner to a primary well tubular in a primary wellbore such that the primary and branch well tubulars form a link for transmission of electrical power and/or signals between the primary and branch wellbores. Low voltage electrical power can be transmitted from the surface to a battery in the branch wellbore to trickle-charge the battery and signals from battery-actuated measuring and control equipment in the branch wellbore can be transmitted back to surface via the walls of the electrically interconnected primary and branch well tubulars.

9 Claims, 3 Drawing Sheets

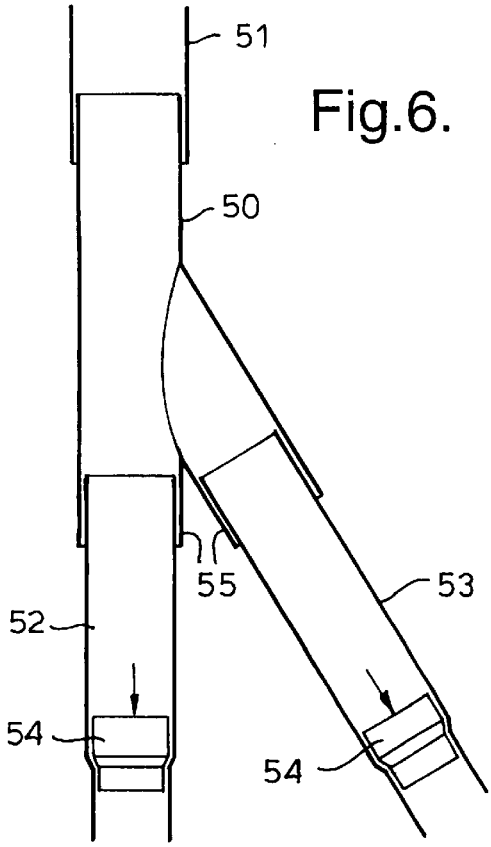
Fig.6.
Fig.7.
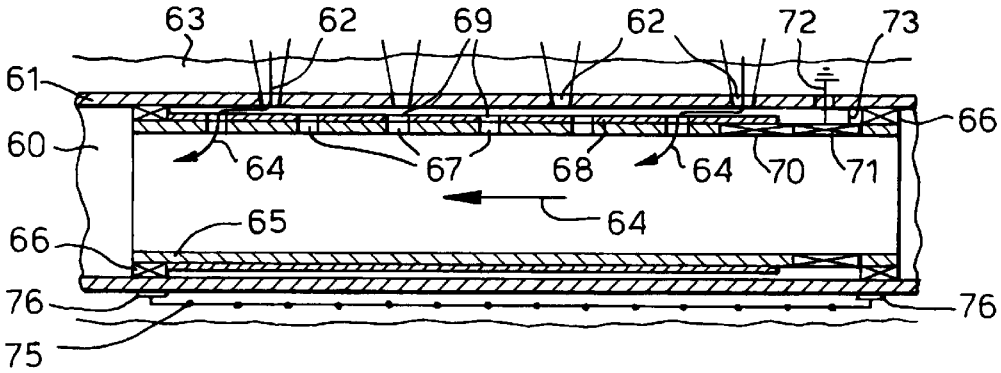
Fig.8.
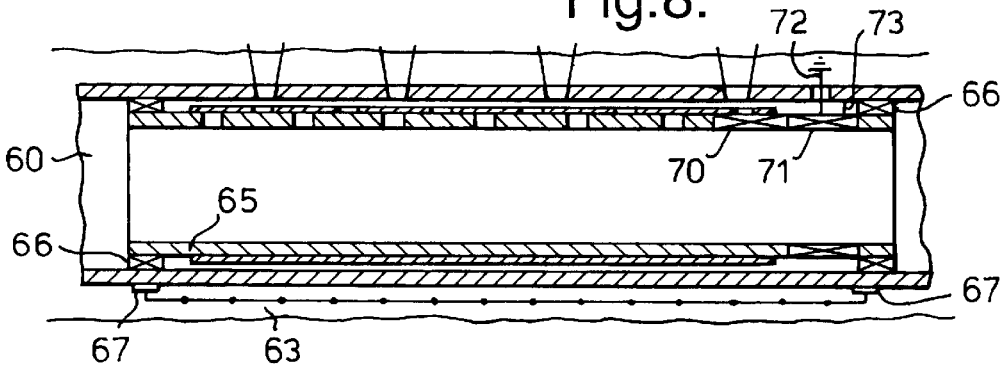

MULTILATERAL WELL AND ELECTRICAL TRANSMISSION SYSTEM

FIELD OF THE INVENTION

The invention relates to a multilateral well and electrical transmission system.

BACKGROUND OF THE INVENTION

Numerous electrical and non-electrical power and communication systems are known for use in unbranched or multilateral oil and/or gas production wells.

U.S. Pat. Nos. 5,706,892; 5,706,896 and 5,721,538 disclose that a multilateral well may be equipped with a hardwired electrical or with a wireless communication system and that such a wireless system preferably transmits acoustic waves through a string of well tubulars such as the production tubing. Disadvantages of the known system are that installation of a wire tree in a multilateral well is a complex and expensive operation and that a wireless acoustic transmission system will suffer from high transmission losses and background noise. These disadvantages are particularly significant if the well is equipped with an expandable casing and/or production tubing. Around such an expanded well tubular there is hardly any or no annular space left for housing of the electrical cables and as a result of the physical contact between the expanded tubular and the surrounding formation acoustic signals will be dampened to a high extent.

Numerous other hardwired or wireless power transmission and communication systems are known, which have in common that they require complex and expensive equipment and that they are not suitable for use in multilateral wells.

U.S. Pat. No. 4,839,644 and European patent No. 295178 disclose a wireless communication system known as "Tucatran" which generates antenna currents in an unbranched well where the production tubing and surrounding well casing are electrically insulated from each other. The requirement of electrical insulation between the tubing and the casing is often difficult to accomplish in e.g. curved borehole sections and areas where brine is present in the tubing/casing annulus. International patent application WO80/00727 discloses another signal transmission system which utilizes an electrical circuit formed by a production tubing and a surrounding well casing.

U.S. Pat. No. 4,484,627, UK patent application No. 2322740 and International patent applications Nos. PCT/GB79/00158; PCT/GB93/01272 and PCT/EP96/00083 disclose other downhole electric transmission systems which utilize an externally insulated tubing in an unbranched well.

The present invention aims to overcome the disadvantages of the known transmission systems and to provide a downhole power and/or signal transmission system which can be used to transmit electrical power and/or signals throughout a multilateral well system in a safe and reliable manner even if the well comprises expandable well tubulars and without requiring complex wire trees or production tubing that are electrically insulated from the surrounding well casings.

SUMMARY OF THE INVENTION

In accordance with the invention there is provided a multilateral well and electric transmission system, which comprises a primary wellbore in which a primary well tubular is arranged and a branch wellbore in which a branch well tubular is arranged, wherein the branch well tubular is connected in an electrically conductive manner to the primary well tubular such that the primary and branch well tubulars form a link for transmission of electrical power and/or signals between the primary and branch wellbore.

Preferably, the primary and branch well tubulars form a link for transmitting low voltage power from a first pole of an electrical power source, which is electrically connected to the primary well tubular, to electrically powered equipment within the branch wellbore which is electrically connected to the branch well tubular. An electrical circuit is created by electrically connecting a second pole of the electrical power source and the branch well tubular(s) to the earth. It is also preferred that said equipment comprises a re-chargeable battery which is trickle-charged by the low voltage electrical power transmitted via the well tubulars.

Suitably low voltage power is transmitted as a direct current (DC) having a voltage of less than 100 V, preferably less than 50 V through the casing or production tubing of the primary well, which is imperfectly insulated to the surrounding earth formation by a surrounding cement or other sealing material, such as an addition curing silicone composition.

At the same time pulsed electromagnetic signals are transmitted which involve changes of voltage level oscillating around the DC voltage level of the well tubular at very low frequency (VLF), between 3 and 20 kHZ, or preferably at extremely low frequency (ELF), between 3 and 300 HZ.

The surface power generator and the downhole equipment or battery may have an electrode which is connected to the earth so that an imperfect electric loop exists between the power generator and the downhole equipment or battery.

It is also preferred that the branch well tubular is a radially expandable tubular which is made of an electrically conductive material and which is radially expanded within the branch well during installation and wherein an electrically conductive receptacle is arranged at or near the branchpoint such that the expanded branch well tubular is pressed into electrical contact with the receptacle as a result of the expansion process.

A particular advantage of the use of expandable tubulars at least in the branch wellbore is that as a result of the radial expansion process a surplus expansion is created in the expanded tubular which will ensure an intimate electrical contact between adjacent well tubulars of which the ends coaxially overlap each other. Such an intimate electrical contact is also made at the branchpoint between the expanded branch well tubular and the receptacle which may be formed by the primary well tubular itself or by a branched bifurcation element.

Suitably the primary and branch well tubulars are made of a formable steel grade and the branch well tubular is expanded during installation such that the expanded branch well tubular has an inner diameter which is at least 0.9 times the inner diameter of the primary well tubular, so that a substantially monobore multilateral well system is created which may have any desired amount of branches and sub-branches.

Preferably the electrically powered downhole well equipment comprises measuring and/or control equipment which is powered by a rechargeable lithium-ion high-temperature or other battery and/or a supercapacitor and/or a downhole energy conversion system such as a piezo-electrical system, turbine or downhole fuel cell and is mounted on an equipment carrier module in the form of a sleeve which is removably secured within the branch well tubular such that one electrode of the battery is electrically connected to the branch well tubular and another electrode of the battery is electrically connected to the subsurface earth formation surrounding the branch wellbore.

Suitably the sleeve spans an inflow area of the branch wellbore where the branch well tubular is perforated, the expandable clamps consist of a pair of expandable packers which seal off an annular space between the branch well tubular and sleeve near each end of the sleeve and wherein the sleeve is provided with one or more fluid inlet ports which can be opened and closed by one or more valves which are powered by the rechargeable battery. The triggering can be done via a downhole or surface actuated control system.

In many lengthy multilateral well systems it is also preferred that at least one of the primary and branch well tubulars is equipped with at least one electrical booster station which station spans an electrically non-conductive section of the well tubular and which station is electrically connected to the electrically conductive parts of the well tubular at both sides of the electrically non-conductive section thereof.

The electrical booster stations may be distributed at regular intervals along the length of the primary and branch wellbores. If an electrical booster station is required at a location where the ends of two adjacent expanded well tubulars co-axially overlap each other, an electrical sealing material may be arranged between the overlapping tubular sections and the booster may be installed as a sleeve within the outermost tubular adjacent to the innermost tubular such that one electrode of the booster station is electrically connected to the innermost and another electrode thereof is connected to the outermost tubular.

It is observed that in some instances the booster station may be installed at a well junction, in which case the electrodes of the booster station will make the electric connection between the primary and branch well tubulars.

It is also observed that when used in specification the and the appended claims the term multilateral well system refers to a well system having a primary or mother wellbore which extends from a wellhead down into a surface earth formation and at least one branch wellbore which intersects the primary or mother wellbore at a subsurface location.

BRIEF DESCRIPTION OF THE DRAWINGS

Preferred embodiments of the system according to the invention will be described with reference to the accompanying drawings, in which

FIG. 6 shows a branchpoint where the branch well casing and the primary casing underneath the branchpoint are expanded within a bifurcation element or splitter;

FIG. 7 shows a tubular equipment carrier sleeve in the open mode such that oil and/or gas flows via perforations in the sleeve into the wellbore; and FIG. 8 shows the sleeve of FIG. 7 in the closed mode in which the perforations have been closed off.

DETAILED DESCRIPTION OF PREFERRED EMBODIMENTS

Figure 1:
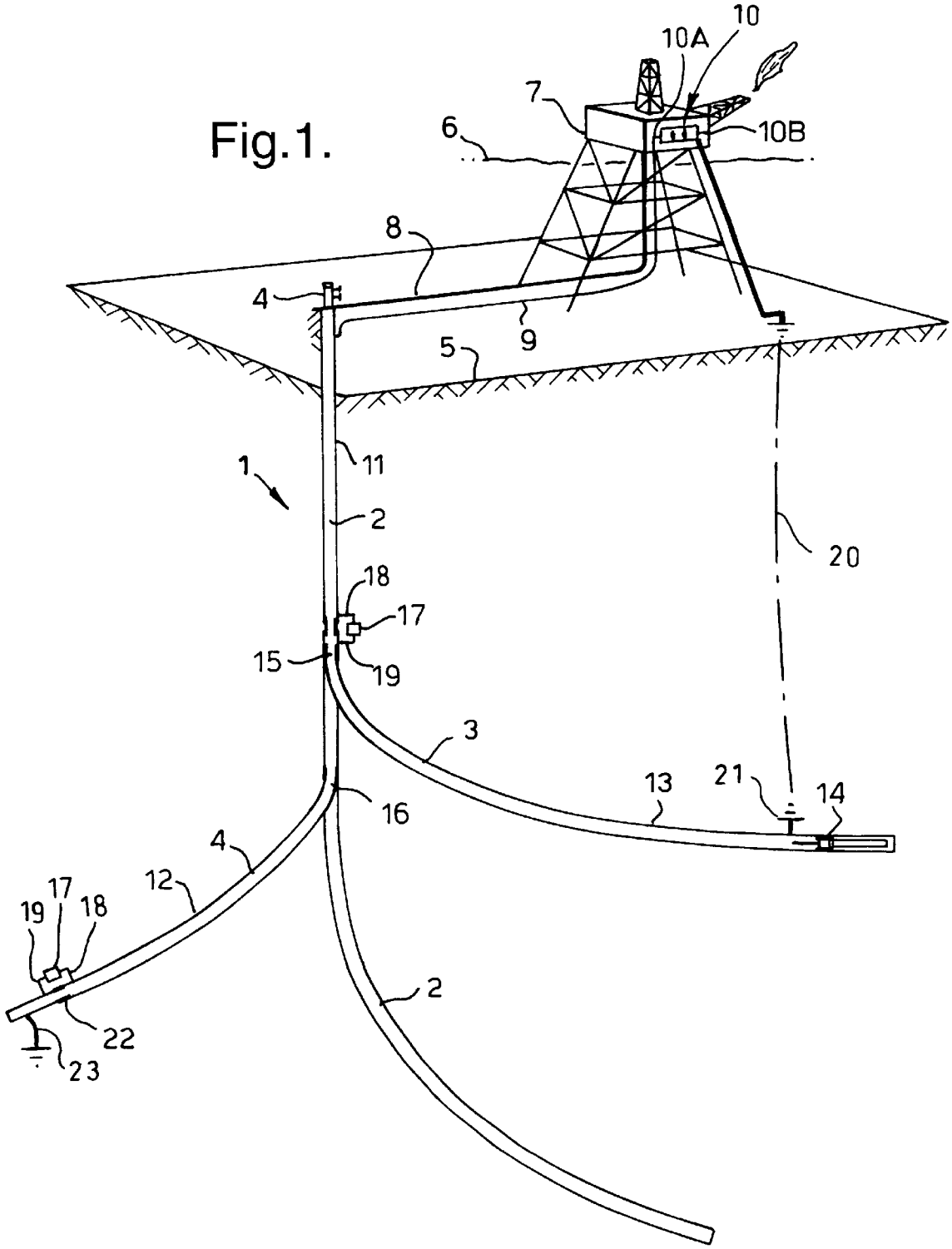
FIG. 1 is a schematic three-dimensional view of a multilateral well system according to the invention.

Referring to FIG. 1 there is shown a multilateral well and electric transmission system 1, which comprises a primary wellbore 2 and two branch wellbores 3 and 4.

The system 1 extends from an underwater wellhead 4 into the bottom 5 of a body of water 6. Oil and/or gas processing equipment on an offshore platform 7 is connected to the wellhead 47 via an underwater flowline 8 and a power supply cable 9 extends from a first pole 10A of an electrical power generator 10 at the platform 7 to primary well casing 11 which has been expanded against the wall of the primary wellbore 2 such that a thin annular layer (not shown) of cement or another sealing material such as an addition curing silicone formulation is present between the expanded casing 11 and borehole wall.

In the lower branch wellbore 4 a branch well liner 12 has been expanded and cemented in place, whereas in the upper branch wellbore 3 a branch well liner 13 is being expanded by pumping or pushing an expansion mandrel 14 therethrough towards the toe of the well.

As a result of the expansion process a surplus expansion is created in the expanded casing or liner which ensures that the expanded branch well liners 12 and 13 are firmly pressed against the inner wall of the primary well casing 11 at the branchpoints 15 and 16 so that an excellent electrical connection is established between the branch well liners 12 and 13 and the primary well casing 11.

In the primary well casing 11 an electrical booster station 17 is arranged at a location where an electric insulation sleeve is mounted within the casing 11 and the casing has been milled away over a selected distance. The booster station 17 has one electrode 18 which is electrically connected to the casing section above the gap and another electrode 19 which is electrically connected below the gap. Likewise a similar booster station 17 is arranged in the lower branch wellbore 4 and has electrodes 18,19 which are connected to sections of the branch well liner 12 which co-axially overlap but which are electrically insulated from each other by an electric insulation sleeve 22. Instead of using co-axial electrically insulated tubular sections the electrical insulation may be achieved also by using a pre-installed plastic section in the well tubular which plastic section is expanded in the same way as the steel parts of the tubular string.

Figure 3:
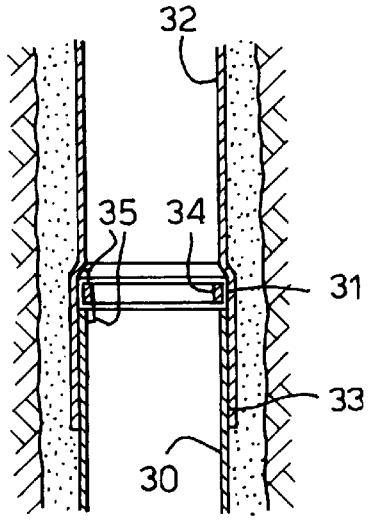
FIG. 3 shows a connection between two well tubulars where an electrical booster station is arranged.

For the sake of clarity the power booster stations 17 are shown outside the wellbore but in general these stations 17 will be mounted in an annular carrier sleeve within the well tubulars as is illustrated in FIG. 3. FIG. 1 also shows schematically that a second pole 10B of the electrical power generator 10 is connected to earth and that also the branch well liners 12 and 13 are connected to earth at one or more selected locations 21 and 23 so that the earth 5 forms an electrical return link, illustrated by phantom line 20, from the well liners 12 and 13 and said second pole 10B.

Figure 2:
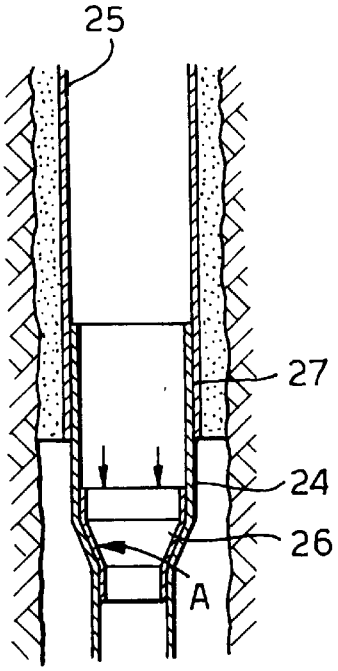
FIG. 2 shows how a well tubular is expanded using a conical expansion mandrel.

FIG. 2 shows how a lower well tubular, which is made of a formable steel grade 24, is expanded inside the lower end of an existing well tubular 25 using an expansion mandrel 26 having a conical ceramic outer surface having a semi top angle A which is 10° and 40°, and preferably between 20° and 30°. The upper well tubular 25 has been cemented within the wellbore 28 and as a result of the expansion process the lower well tubular obtains a surplus expansion so that its inner diameter becomes larger than the outer diameter of the mandrel 26 and the expanded lower tubular 24 is firmly pressed against the overlapping lower part 27 of the upper tubular 25 so that a reliable electrical connection is created between the lower and upper well tubulars 24 and 25.

FIG. 3 illustrates a location where a lower tubular 30 has been expanded within a widened lower end 31 of an upper well tubular 32 and an electrical insulation sleeve 33 is arranged between the co-axial tubular parts.

A ring-shaped electrical power booster station 34 is arranged within the widened lower end 31 of the upper tubular 32 just above the top of the lower tubular 30. The station 34 is equipped with electrodes 35 which establish an electrical connection between the tubulars 30 and 32.

Figure 4:
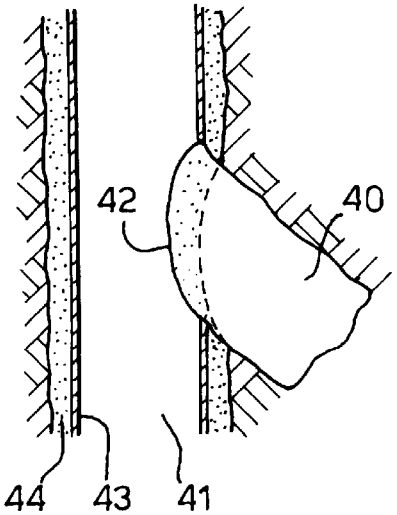
FIG. 4 shows a branchpoint where a branch wellbore has been drilled through a window in the primary well casing.

FIG. 4 shows how a branch wellbore 40 is drilled away from a primary wellbore 41 through an opening 42 that has been milled in the primary well casing 43 and the surrounding cement annulus 44.

Figure 5:
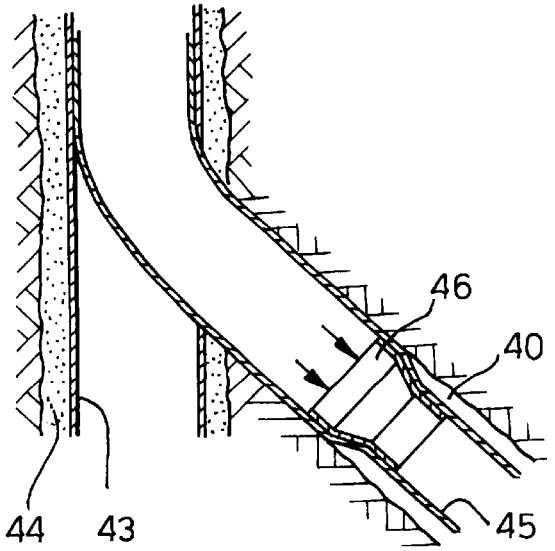
FIG. 5 shows how an expandable well liner is expanded in the branch wellbore and electrically connected to the primary well casing.

FIG. 5 shows how an expandable branch well liner 45 is expanded in the branch wellbore 40 of FIG. 4 by an expansion mandrel 46 which is similar to the mandrel 26 shown in FIG. 2.

As a result of the surplus expansion during the expansion process the branch well liner 45 is elastically pressed against the inner wall of the primary well casing 43 and to the rims of the opening 42 thereby establishing a firm electrical connection between the primary well casing 43 and the branch well liner 44 which connection remains reliable throughout the lifetime of the well.

FIG. 6 shows a branchpoint in a multilateral well system where a bifurcation element 50 or splitter is secured and electrically connected (optionally via an electric booster station as illustrated in FIG. 3) to an upper primary well casing 51.

A lower primary casing section 52 and a branch well liner 53 are each radially expanded by an expansion mandrel 54 inside the primary and branch wellbores such that the upper ends of the lower primary casing section 52 and said liner are firmly pressed against the lower branches of the bifurcation element 50 which serve as an electric contact and receptacle.

FIG. 7 shows an inflow section of a branch wellbore 60 where the branch well liner 61 has perforations 62 through which oil and/or gas is allowed to flow from the surrounding oil and/or gas bearing formation 63 into the wellbore 60 as illustrated by arrows 64.

An equipment carrier sleeve 65 is sealingly secured inside the liner 61 by means of a pair of expandable packers 66.

The sleeve 65 has perforations 67 and is surrounded by a movable sleeve-type valve body 68 which has perforations 69 which are, in the position shown in fig. 7, aligned with the perforations 67 of the sleeve 65. Because of the alignment of the perforations 67 and 69 oil and/or gas is permitted to flow into the wellbore 60.

FIG. 8 shows how the sleeve-type valve body 68 is moved such that the perforations 67 and 69 are unaligned and flow of oil and/or gas from the formation 63 into the wellbore 60 is interrupted.

The motion of the sleeve type valve body 68 is achieved by an electrical actuator 70 which is powered by a rechargeable lithium-ion high temperature battery 71, which has one electrode 72 which is electrically connected to the surrounding formation and another electrode 73 which is electrically connected to the liner 61.

The electrical direct current (DC) power which is transmitted via the primary casing (not shown) to the branch well liner 61 is used to trickle charge the battery 71. The battery 71 powers the valve actuator 70 and optionally also flow, pressure, temperature, composition, reservoir imaging and/or seismic equipment (not shown) carried by the sleeve 65 and signals generated by the equipment are transmitted to surface monitoring equipment by transmission of VLC or ELC pulsed electromagnetic signals which involve voltage level oscillations around the DC voltage level of the branch well liner 61 via the electrode 72 and said liner 61 to the primary well casing (not shown) and an electrical cable connected to the upper end of said casing (as is shown in FIG. 1) to surface monitoring and/or control equipment.

In the example shown in FIG. 7 the battery 71 is a tubular ceramic lithium-ion high-temperature battery and a series of reservoir imaging sensors 75 are embedded in the formation 63 surrounding the wellbore 60. These sensors 75 transmit and/or receive signals via inductive couplers 76 which are connected to signal processing equipment (not shown) mounted on the sleeve 65. Said processing equipment is able to actuate the valve body 68 and/or to transmit electric reservoir imaging data acquired by the sensors 75 via the wall of the well liner 61 and well tubulars in the primary or mother wellbore to production monitoring equipment at the platform or other surface facilities as illustrated in FIG. 1.

We claim:

1. A multilateral well and electric transmission system, comprising:

a primary wellbore in which a primary well tubular is arranged; and a branch wellbore in which a branch well tubular is arranged;

wherein the branch well tubular is connected in an electrically conductive manner to the primary well tubular such that the primary and branch well tubulars form a link for transmission of electrical power and/or signals between the primary and branch wellbore;

wherein the primary and branch well tubulars form a link for transmitting low voltage power from a first pole of an electrical power source which is electrically connected to the primary well tubular to electrically powered equipment within the branch wellbore which is electrically connected to the branch well tubular, and wherein a second pole of the electrical power source and the branch well tubulars are electrically connected to the earth;

wherein the electrically powered equipment comprises a re-chargeable battery which is trickle-charged by the low voltage electrical power transmitted via the well tubulars;

wherein the electrically powered equipment comprises measuring and/or control equipment which is powered by a rechargeable lithium-ion high-temperature battery and is mounted on an equipment carrier module which is removably secured within the branch well tubular such that one electrode of the battery is electrically connected to the branch well tubular and another electrode of the battery is electrically connected to the subsurface earth formation surrounding the branch wellbore;

wherein the equipment carrier module formed by a sleeve which is removably connected within the branch well tubular by means of a number of expandable clamps; and wherein the sleeve spans an inflow area of the branch wellbore where the branch well tubular is perforated, the expandable clamps consist of a pair of expandable packers which seal off an annular space between the branch well tubular and sleeve near each end of the sleeve and wherein the sleeve is provided with one or more fluid inlet ports which can be opened and closed by one or more valves which are powered by the rechargeable battery.

2. The multilateral well and electric transmission system of claim 1, wherein the branch well tubular is a radially expandable tubular which is made of an electrically conductive material and which is radially expanded within the branch well during installation and wherein an electrically conductive receptacle is arranged at or near a branchpoint such that the expanded branch well tubular is pressed into electrical contact with the receptacle as a result of the expansion process.

3. The multilateral well arid electric transmission system of claim 2, wherein the receptacle is formed by the primary well tubular itself and the branch tubular has a downstream end which is radially expanded against the inner wall of the primary well tubular and extends through a window in the primary well tubular into the branch wellbore.

4. The multilateral well and electric transmission system of claim 2, wherein the receptacle is formed by a tubular branch section of a bifurcation element, which bifurcation element has a primary section which is electrically connected to the primary well tubular and the tubular branch section extends from the primary wellbore into the branch wellbore.

5. The multilateral well and electric transmission system of claim 2, wherein the primary and branch well tubulars are made of a formable steel grade and the branch well tubular is expanded during installation such that the expanded branch well tubular has an inner diameter which is at least 0.9 times the inner diameter of the primary well tubular.

6. The multilateral well and electric transmission system of claim 1, wherein at least one of the primary and branch well tubulars is equipped with at least one electrical booster station, which station spans an electrically non-conductive section of the well tubular and which station is electrically connected to an electrically conductive parts of the well tubular at both sides of the electrically non-conductive section thereof.

7. The multilateral well and electric transmission system of claim 6, wherein the electrically non-conductive section of the well tubular is formed by an electrically non-conductive annular seal which is arranged between overlapping co-axial sections of the well tubular and wherein the electrical booster station is arranged within the outermost section of the well tubular near the end of the innermost section of the well tubular such that one electrode of the electrical booster station is connected to said outermost section and another electrode of said station is electrically connected to said innermost section.

8. The multilateral well and electrical transmission system of claim 7, which comprises a plurality of branch wellbores and a plurality of electrical booster stations.

9. A sleeve-type equipment carrier module for use in a multilateral well and electric transmission system according to claim 1, which module is sealingly securable in an inflow region of the well and comprises one or more fluid inlet ports which can be opened and closed by one or more valves which are powered by a rechargeable battery which is in use trickle charged by transmitting low voltage electrical power through tubulars in the primary and branch wellbore.

* * * * *